US006024223A

United States Patent [19]

Ritter

[11] Patent Number: 6,024,223

[45] Date of Patent: Feb. 15, 2000

[54] STORAGE CONTAINER INCLUDING A MOUNTING CLIP AN ASSOCIATED MOUNTING CLIP, AND AN ASSOCIATED METHOD

[75] Inventor: Lawrence A. Ritter, Worcester, Mass.

[73] Assignee: Technology Container Corporation, Shrewsbury, Mass.

[21] Appl. No.: 09/244,646

[22] Filed: Feb. 4, 1999

[51] Int. Cl.[7] ..... B65D 19/00

[52] U.S. Cl. ..... 206/600; 206/386; 220/1.5; 220/4.33

[58] Field of Search ..... 206/386, 598, 206/600; 220/4.34, 4.33, 1.5; 292/44, 45, 194

[56] References Cited

U.S. PATENT DOCUMENTS

| | | | |
|---|---|---|---|
| 4,506,798 | 3/1985 | Goutille | 220/1.5 |
| 4,626,155 | 12/1986 | Hlinsky et al. | 220/1.5 |
| 4,741,449 | 5/1988 | Bersani | 220/4.33 |
| 5,109,985 | 5/1992 | Rose | 206/600 |
| 5,123,541 | 6/1992 | Giannini et al. . | |
| 5,190,179 | 3/1993 | Richter et al. | 220/1.5 |
| 5,722,328 | 3/1998 | Darby | 206/600 |
| 5,862,917 | 1/1999 | Noble et al. | 206/600 |

*Primary Examiner*—David T. Fidei
*Attorney, Agent, or Firm*—David V. Radack; Eckert Seamans Cherin & Mellott, LLC

[57] ABSTRACT

A storage container including a pallet having a section which defines a mounting clip receiving slot and a sidewall structure having a mounting clip secured near an edge thereof. The mounting clip has a first section including a movable latch/release handle and a second section including a locking toggle operatively associated with the movable latch/release handle. The second section is inserted into the slot and the locking toggle is moved by the movable latch/release handle from an unlatched position to a latched position. In this way, the sidewall structure is attached to the pallet. The invention also includes the mounting clip itself (as described above) as well as a method of forming a storage container wherein a pallet, a bin and a mounting clip.

26 Claims, 7 Drawing Sheets

STORAGE CONTAINER INCLUDING A MOUNTING CLIP AN ASSOCIATED MOUNTING CLIP, AND AN ASSOCIATED METHOD

BACKGROUND OF THE INVENTION

This invention relates to a storage container including a mounting clip, an associated mounting clip and an associated method.

Storage containers, such as storage bins for holding parts, etc. are known. These storage containers consist of a base, usually a pallet, and a sidewall structure. This sidewall structure can be made from plastic. As these storage containers can be bulky, it is desired to make these storage containers from modular parts which can be stored and disassembled separately. A crucial part of the modular storage container is a mounting/attachment clip which connects the sidewall structure to the base or pallet.

U.S. Pat. No. 5,123,541 discloses such a mounting clip for use in a modular storage container. A clip embodying the patented invention is sold under the trade name, EVER-LOK by Trienda Corporation of Portage, Wis. This clip includes a resilient flex arm including a locking face for engaging an edge of a receiving slot in the pallet. While somewhat effective, this mounting clip has several disadvantages.

Most notably, when it is time to disassemble the storage container and remove the clip from the slot in the pallet, the resilient flex arms of two or more mounting clips must be released simultaneously and held in the compressed position while at the same time lifting the container sidewall and pushing up the flex arms through the slots. To further complicate matters, the remaining clips remain locked in place on the opposite wall effectively creating a spring loaded hinge pulling downward and opposing the intended upward movement. Persons with limited strength and/or dexterity find this movement difficult. Thus, disassembly by one individual is nearly impossible. Finally, in order to squeeze the clip, one must reach one's hand under the pallet. This may mean bending down making for a poor ergonomic lifting position and may also require a person to lie down on a dirty shop floor in order to remove the sidewall from the pallet.

A second generation of mounting clip has been sold by the Trienda Company under the trade designation EVER-LOK 2. In this version, the resilient flex arm has been replaced by a turning handle which can engage and disengage from the slot. While eliminating the problem with the resilient flex arm, the turning handle is also disposed under the pallet, thus making access thereto difficult.

What is needed, therefore, is an improved mounting clip which eliminates the problems associated with prior art clips, but which is itself easy to use and inexpensive to manufacture.

SUMMARY OF THE INVENTION

The storage container of the invention has met or exceeded the above-mentioned needs as well as others. The storage container includes a pallet having a section which defines a mounting clip receiving slot and a sidewall structure having a mounting clip secured near an edge thereof. The mounting clip has a first section including a movable latch/release handle and a second section including a locking toggle operatively associated with the movable latch/release handle. The second section is inserted into the slot and the locking toggle is moved by means of the movable latch/release handle from an unlatched position to a latched position. In this way, the sidewall structure is attached to the pallet.

The invention also includes the mounting clip itself (as described above) as well as a method of forming a storage container wherein a pallet, a bin and a mounting clip.

BRIEF DESCRIPTION OF THE DRAWING

A full understanding of the invention can be gained from the following detailed description of the invention when read in conjunction with the accompanying drawings in which.

DETAILED DESCRIPTION

Figure 1:
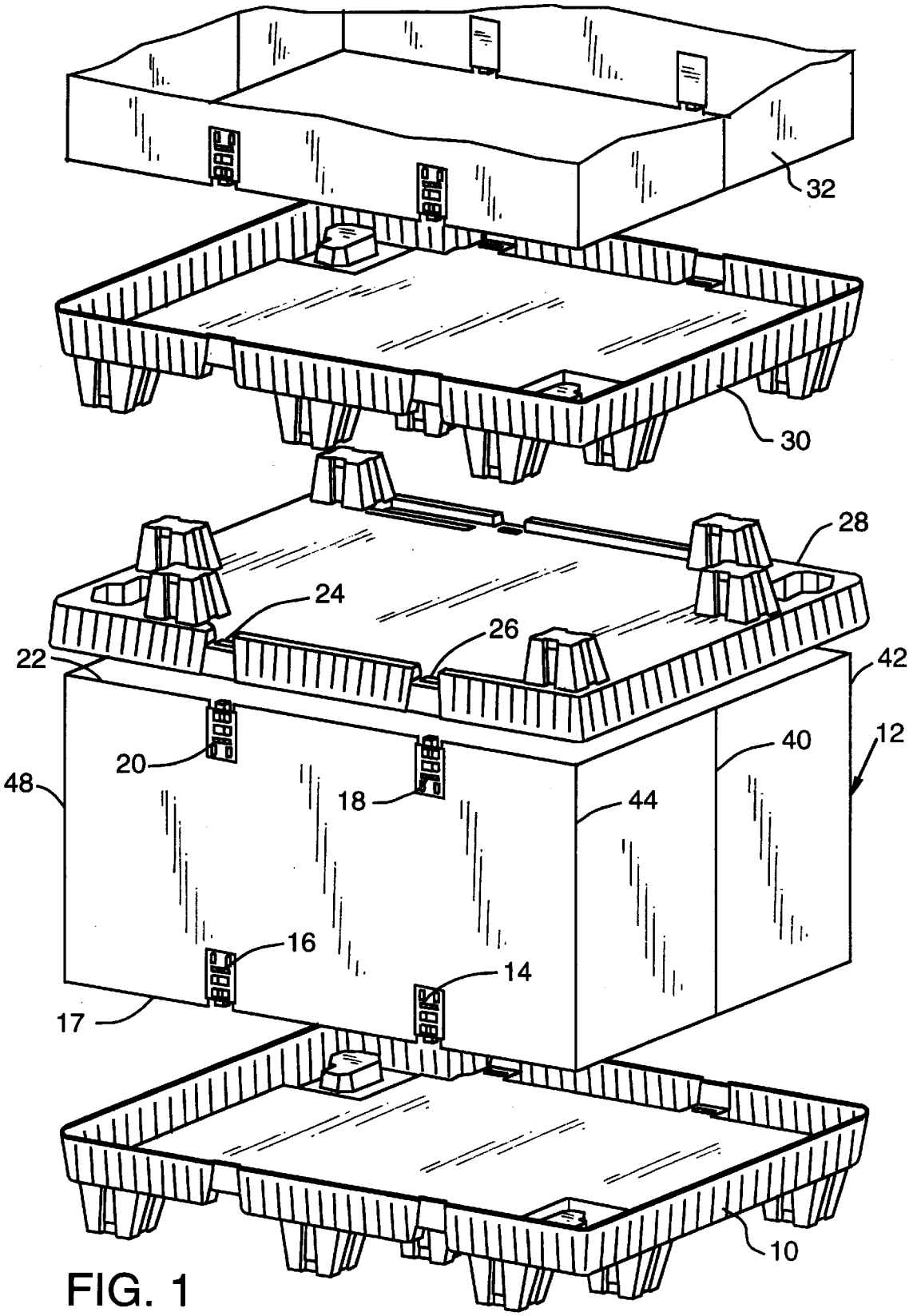
FIG. 1 is an exploded perspective view showing two storage containers of the invention stacked on top of each other.

Referring to FIG. 1, a stack of storage containers are shown. It will be appreciated that because of the design of the pallets, a series of storage containers can be stacked one on top of the other. Alternatively, the storage container of the invention can be used as a storage bin, including only a single pallet resting on the floor, with the sidewall structure and clip forming an open storage area. In FIG. 1, a first pallet 10 rests on the floor. A first sidewall structure 12, made preferably of corrugated plastic, includes several mounting clips 14, 16, 18 and 20. The sidewall can be made of any material, such as wood or corrugated paper. It will be further appreciated that four (4) other mounting clips are on the opposite side of the storage container making for a total of eight clips for the sidewall structure 12. The structure of the mounting clip of the invention will be discussed in detail below. Mounting clips 14 and 16 provided on the bottom edge 17 of the first sidewall structure 12 engage into slots (not shown in FIG. 1) in first pallet 10 in order to form a storage container. Mounting clips 14 and 16 are attached to the first sidewall structure 12 as will be explained below.

Mounting clips 18 and 20 are provided on the top edge 22 of the sidewall structure 12 and engage into slots 24 and 26 of a second pallet 28. This design is conventional and well known in the art. Finally, a second sidewall structure 32 can be secured to the third pallet 30 in order to form a stack of storage containers. It will be appreciated that any number of storage containers can be stacked on top of each other.

Figure 2:
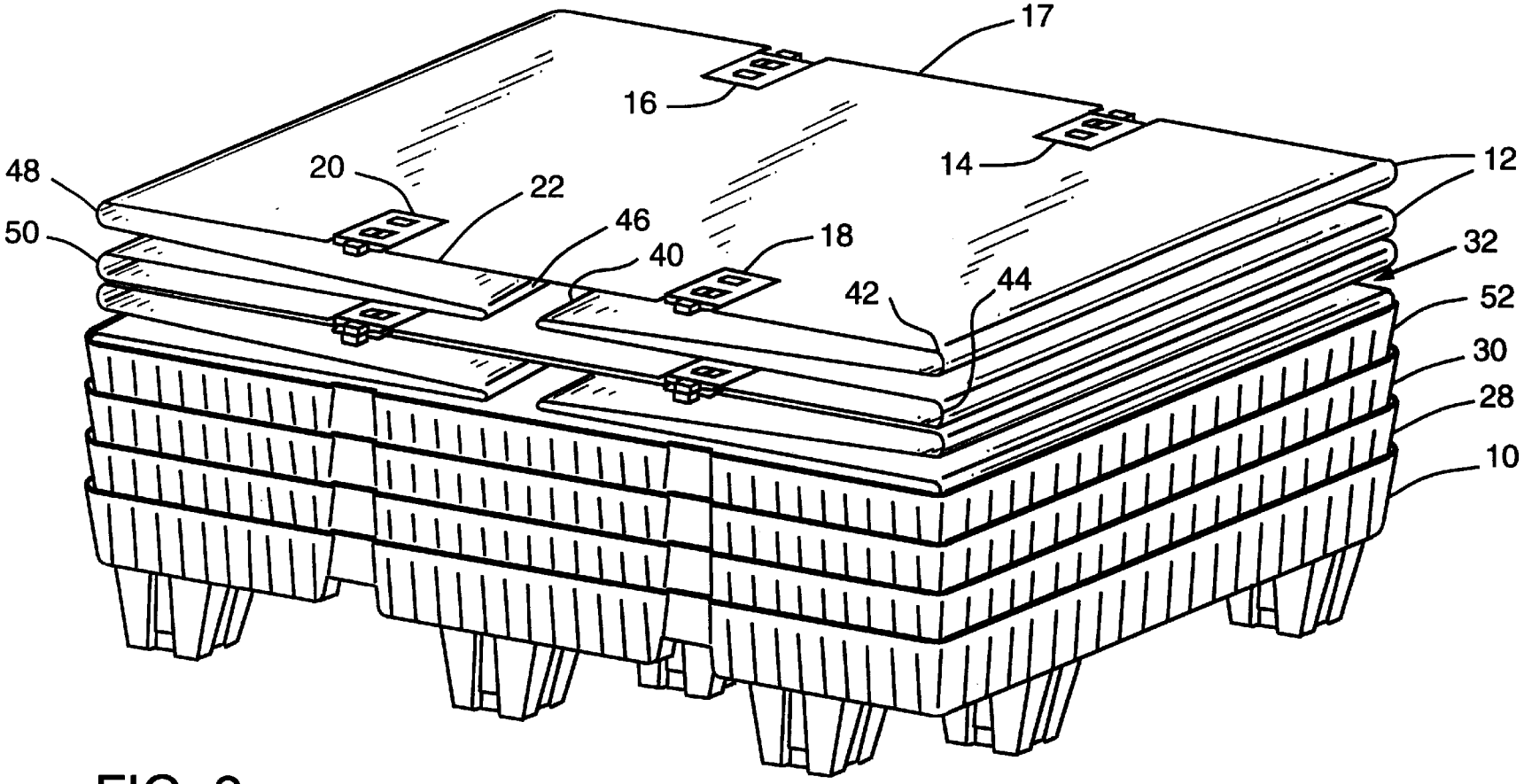
FIG. 2 shows a stack of pallets and a plurality of sidewall structures in their folded position.

When the storage containers are not in use, the sidewall structures can be folded flat and stacked on top of each other as shown in FIG. 2. The sidewall structures can be folded by means of a first Z-fold 40 disposed between the corners 42 and 44 of the sidewall structure. There is also a second Z-fold 46 (not shown in FIG. 1) between corners 48 and 50. As can be seen in FIG. 2, the pallets 10, 28, 30 and 52 are nested when stacked one on top of the other so as to minimize the space taken up thereby.

Figure 3:
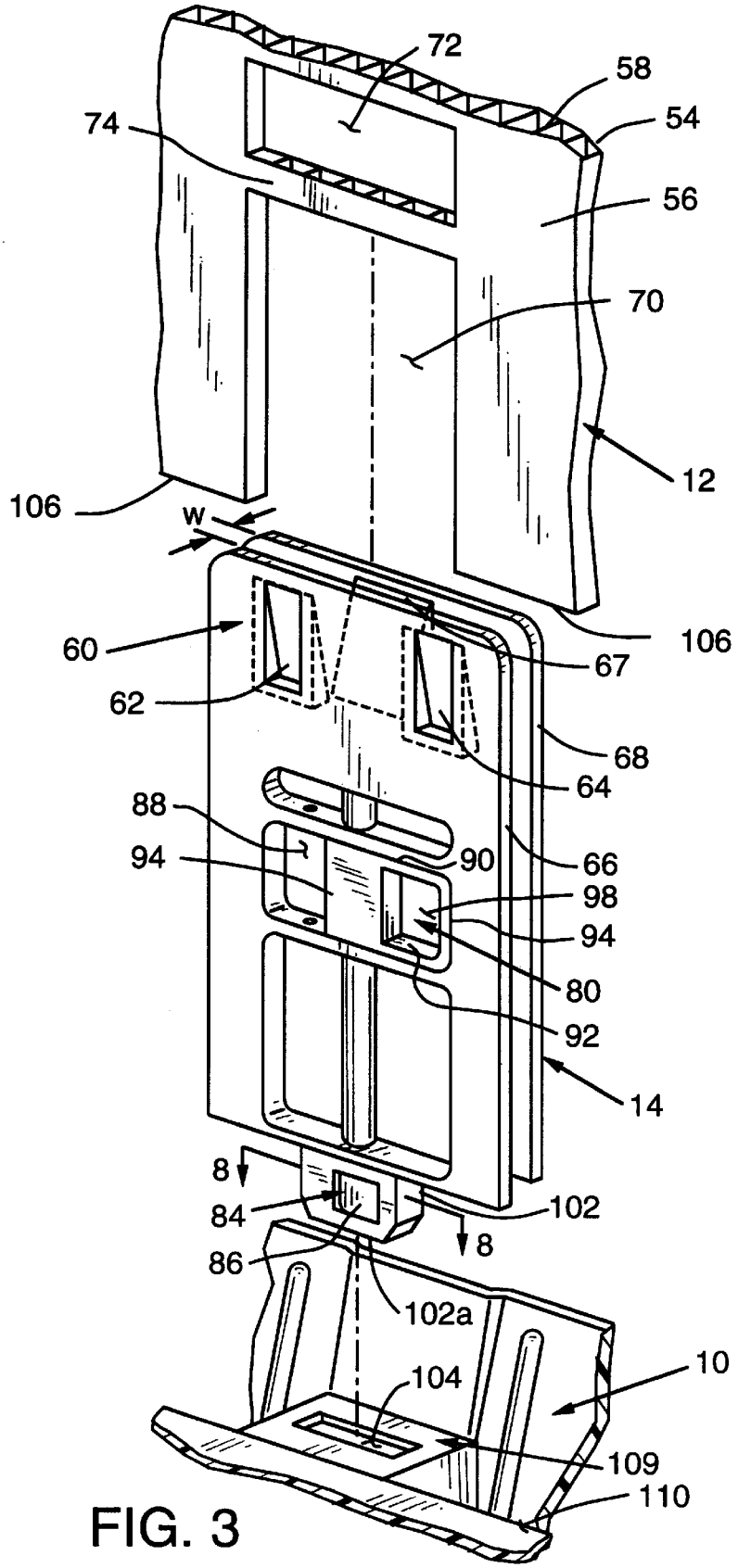
FIG. 3 is a detailed exploded perspective view of a portion of the sidewall structure, the mounting clip and the pallet.

Referring now to FIGS. 3–7, the mounting clip of the invention will be discussed in detail. FIG. 3 is a detailed view of mounting clip 14 which will be secured to a portion of the sidewall structure 12. The cross-section of sidewall structure 12 shown in FIG. 3, shows the design of the corrugated plastic used for the sidewall structure 12. There is an inner plastic wall 54 and an outer plastic wall 56 which are connected by ribs 58. This design is conventional and well known in the art.

The mounting clip 14 can be attached to the sidewall structure 12 in either a removable or permanent manner. The sidewall structure 12 includes a diecut opening 70, a diecut slot 72 and a bridging section portion 74. To mount the clip in a removable/replaceable the mounting clip is aligned with the diecut opening 70 and guided inwardly. Mechanical securement means 60 made up of three wedge shaped pieces 62, 64 and 67 are provided which will self open the resilient body portion of the mounting clip 14 thus allowing passage over the bridged section 74 before again self closing in diecut slot 72. Wedges 62, 64 and 67 are approximately ⅔ the thickness of the sidewall 12 at the lowest/thickest point and because of this when closed they form interlocking fingers to resist pulling away from the sidewall portion. Removal of the clip 14 for repair or replacement will be accomplished by manually spreading the wedge shaped sections 62, 64 and 67 and simply slipping the clip out of the diecut opening 70. Permanently attaching the clip may also be accomplished with the application of an adhesive to first wall 66 and/or second wall 68 of the mounting clip 14 preventing its removal and adding additional safeguards that may possibly be necessary under extremely heavy tensile loading.

The mounting clip 14 broadly includes first section 80 which includes movable latch/release handle 82 and a second section 84 that includes a locking toggle 86. The movable latch/release handle 82 is operatively associated with the locking toggle 86 so that when the movable latch/release handle 82 is rotated, there is movement of the locking toggle 86 as will be explained in detail with regard to FIG. 7. The movable latch/release handle 82 is disposed in an opening 88 formed between the two walls 66 and 68. The movable latch/release handle 82 is generally square in shape and includes a top section 90, bottom section 92 and free end section 94. The movable latch/release handle 82 also includes a section 96 about which the remainder of the movable latch/release handle 82 rotates. All of these sections define a finger hole opening 98 that allows for easy manipulation of the movable latch/release handle 82. It, like all other part of the mounting clip 14, is made of a plastic material.

The locking toggle 86 is enclosed in a cage-like section 102 which protects the locking toggle 86 and which increases the entire strength of the mounting clip 14. The cage-like section 102 along with the locking toggle 86 is inserted into a slot 104 formed in the pallet 10, as will be discussed below with respect to FIG. 4.

Figure 4:
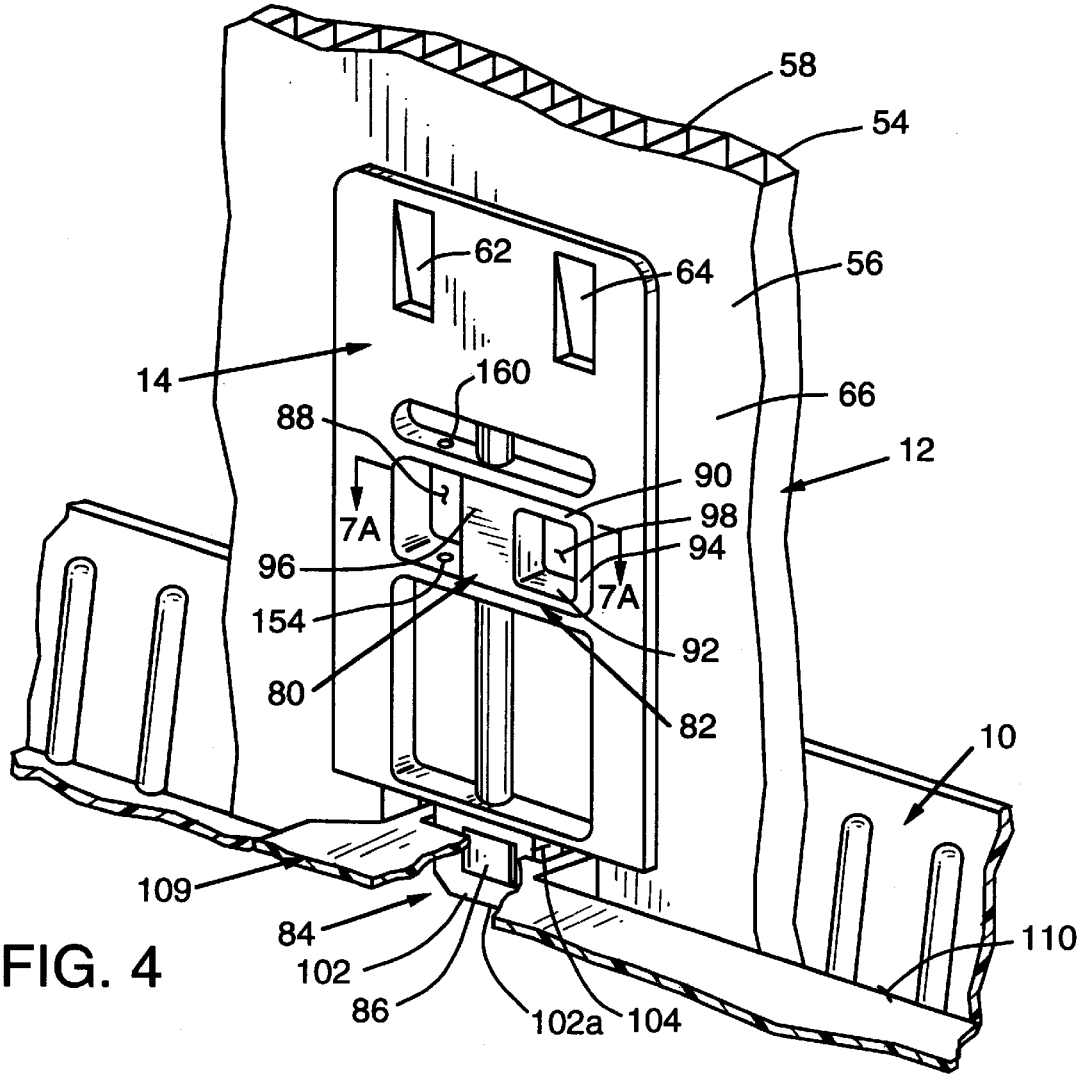
FIG. 4 is a detailed perspective view showing the mounting clip being initially inserted into the receiving slot (unlatched position).

Referring now particularly to FIG. 4, the mounting clip 14 is disposed within the opening of the first sidewall structure 12. Preferably, the bottom edge 102*a* of the cage-like assembly 102 is aligned with the bottom edge 106 of the sidewall structure 12 (see FIG. 3). In this way, the cage-like assembly 102 will not extend beyond the bottom edge 106 of the sidewall structure 12. This is advantageous for stacking the sidewall structure 12 and also protects the cage-like assembly 102 and the locking toggle 86 from damage.

In order to insert the second section 84 into the slot 104 (see also, FIG. 3 of the pallet 10), the locking toggle 86 must be in the unlatched position. This is accomplished by positioning the movable latch/release handle 82 to the right most portion, as shown in FIG. 4. By "unlatched position" is meant that the locking toggle 86 is generally in the same plane as the cage-like assembly 102 as shown in FIG. 4. This will allow the cage-like assembly 102 with locking toggle 86 to be inserted in the slot 104. It will be appreciated that the second section 84 and especially the locking toggle 86 will be disposed beneath the plane formed by the raised portion 109 of the pallet 10 that defines the slot 104. Furthermore, it is preferred that the pallet 10 has a channel 110 disposed on either side of the raised portion 109 defining the slot 104. In this way, the sidewall structure 12 is further supported by the pallet 10. This channel design is necessary when the bottom edge 102*a* of the cage-like assembly 102 is aligned with the bottom edge 106 of the sidewall structure 12, the advantages of which were discussed above.

Now that the cage-like assembly 102 is inserted into the slot 104, the locking toggle 86 is then latched in order to lock the sidewall structure 12 to the pallet 10. This is accomplished by rotating the movable latch/release handle 82 180° to the position shown in FIG. 5. As will be explained in detail with respect to FIGS. 6–7 below, this will cause the locking toggle 86 to rotate 90° to the "latched position" shown in FIG. 5. By "latched position" it is meant that the locking toggle 86 lies in a plane that is generally perpendicular to the plane in which the cage-like assembly 102 lies. As will be appreciated, the latched position of the locking toggle 86 will prevent removal of the clip 14 (and thus the sidewall structure) from the slot 104, because the locking toggle 86 will be preventing from disassembling with the pallet due to the interference of the locking toggle 86 against the underside 109*a* of the raised portion 109 if the sidewall structure 12 is attempted to be lifted away from the pallet. The slot 104, therefore, will be dimensioned so that the second section 84 of the clip 14 can be inserted therein when the locking toggle 86 is in the unlatched position but cannot be removed after insertion when the locking toggle 86 is in the latched position.

Figure 5:
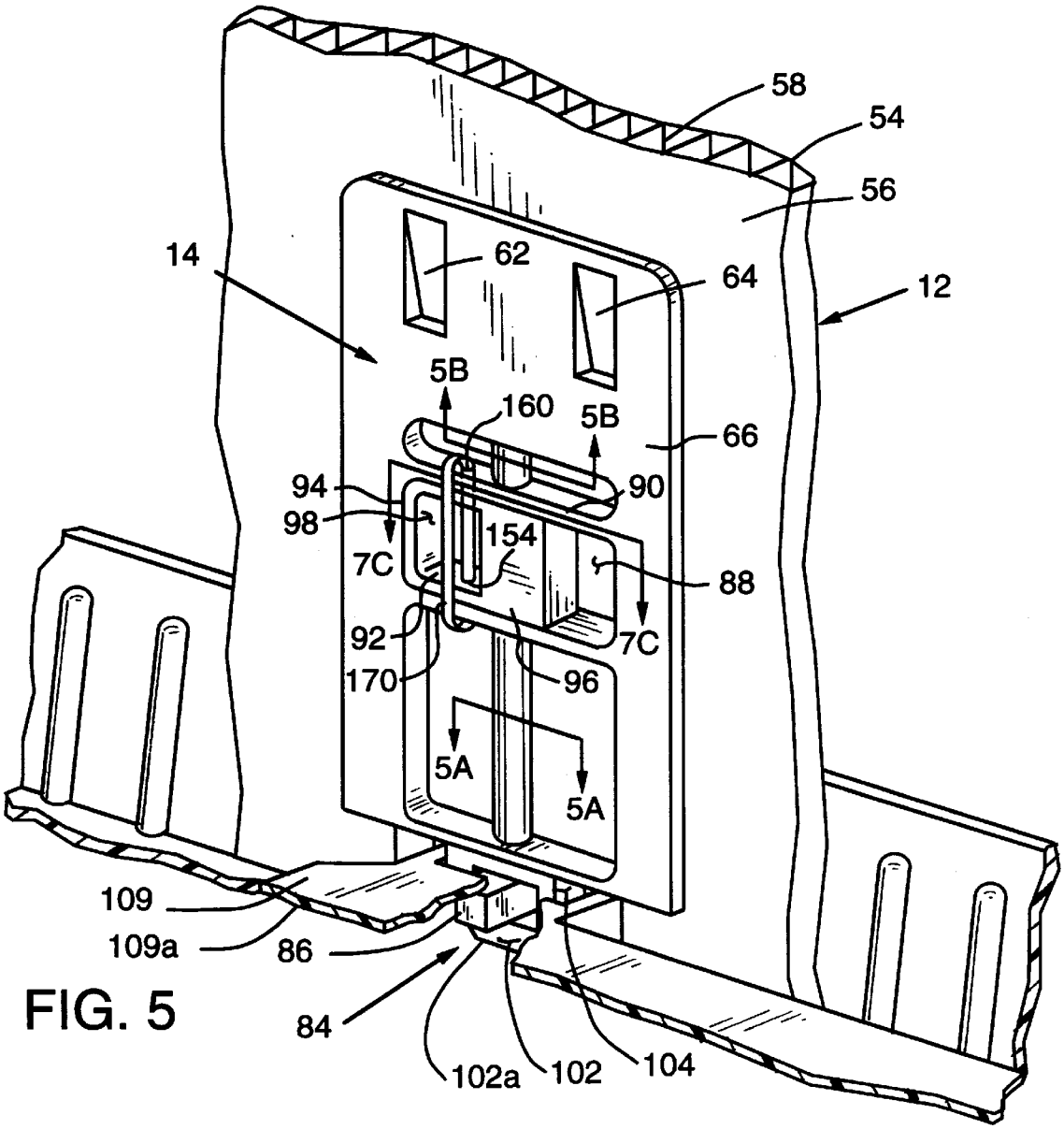
FIG. 5 is a detailed perspective view showing the mounting clip in a latched position, securing the sidewall structure to the pallet.
Figure 6:
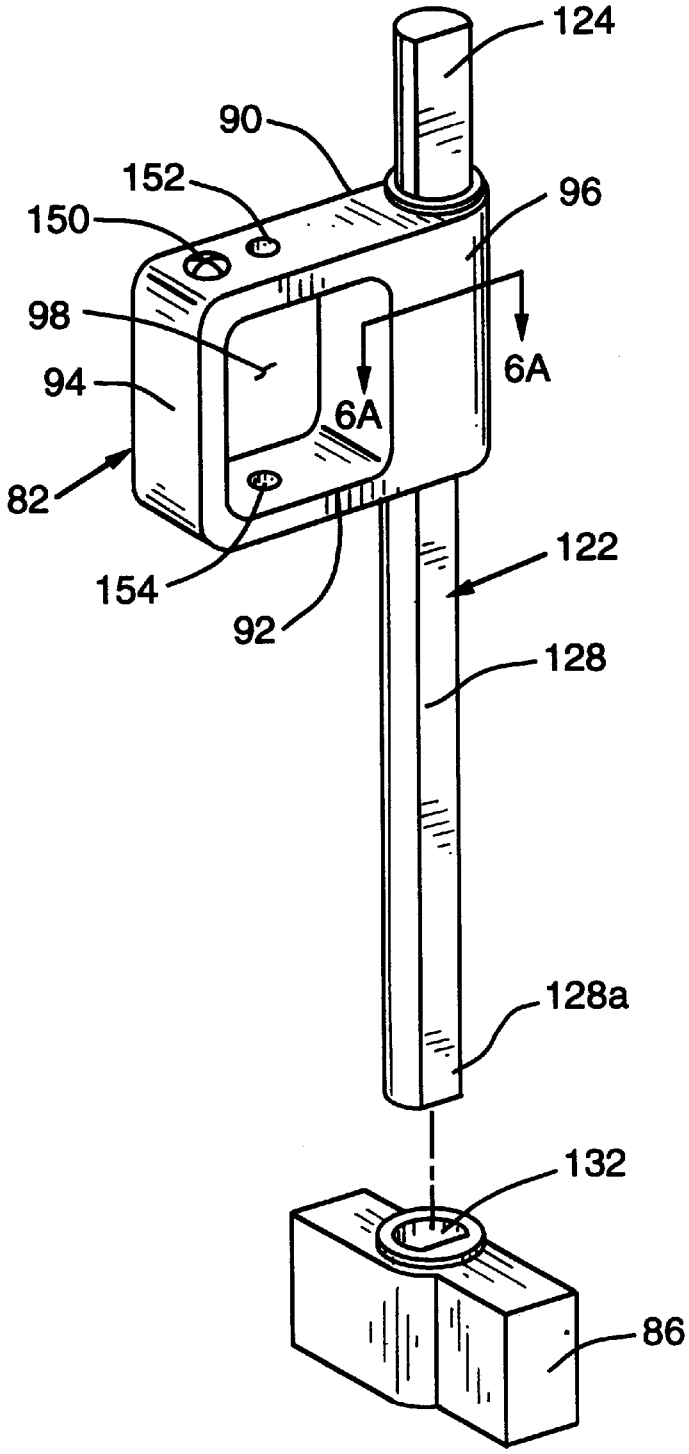
FIG. 6 is a perspective view of the handle, shaft and locking toggle disassembled from the mounting clip.

Referring now to FIGS. 6 and 7, the operation of the movable latch/release handle 82 will be explained. One of the broad features of the invention is that 180° movement of the movable latch/release handle 82 will result in 90° movement of the locking toggle 86. This advantageous feature allows the movable latch/release handle 82 to lie generally flat in the same plane as the sidewall structure when either in the unlatched position (FIG. 4) or latched position (FIG. 5).

Figure 5A:
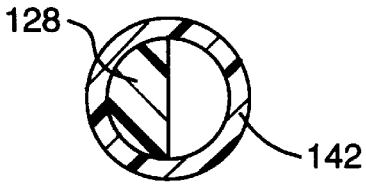
FIG. 5A is a cross-sectional view taken along line 5A—5A of FIG. 5.
Figure 5B:
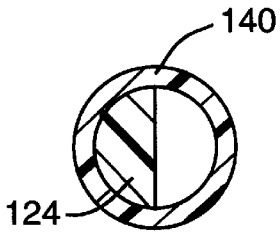
FIG. 5B is a cross-sectional view taken along line 5B—5B of FIG. 5.
Figure 6A:
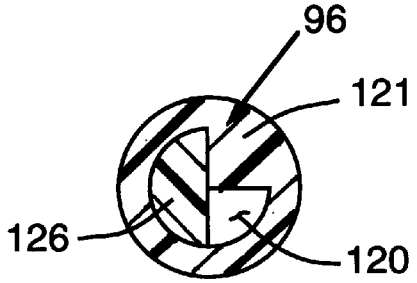
FIG. 6A is a cross-sectional view taken along line 6A—6A of FIG. 6.

One structure to accomplish this action is shown in FIGS. 6 and 7. The section 96 of the movable latch/release handle 82 defines a shaft opening 120 having a cross-section extending through 270°. This creates a pie-shaped section 121 which extends over an arc of approximately 90°. This is shown best in FIG. 6A. Into this shaft opening 120 is inserted a shaft 122 having an upper half shaft section 124, an intermediate half shaft section 126, and a lower half shaft section 128. The lower portion 128*a* of the lower full shaft section 128 is secured into a D-shaped opening 132 in the locking toggle 86 in order to connect the movable latch/release handle 82 to the locking toggle 86 via the shaft 122. As shown in FIGS. 5A and 5B, the upper half shaft section 124 is enclosed in an upper tube section 140 (FIG. 5B), the upper tube section 140 being secured to the mounting clip 14 allowing free rotation of the upper half shaft section 124 therein. Similarly, the lower full shaft section 128 is enclosed in a lower tube section 142 (FIG. 5A), the lower tube section 142 being secured to the mounting clip 14 allowing free rotation of the lower full shaft section 128.

FIG. 6 also shows a detent 150 that aids in securing the handle 82 to the mounting clip 14 when the handle 82 is in the latched or unlatched position. The detent 150 extends a slight distance from the surface of the top section 90 of the handle 82 and engages against a portion of the mounting clip 14. Another feature of the invention is the provision of hole 152 in section 90 and hole 154 in section 92 of the movable latch/release handle 82. These holes 152 and 154 are aligned with complementary holes 160 and (not shown) respectively when the movable latch/release handle 82 is in the latched position (FIG. 5). In order to secure the clip 14 into the latched position, a binding member such as wire, wire tie or padlock, (a wire tie 170 is shown in FIG. 5) can be passed through the holes. The binding member will secure the handle 82 to the clip 14, thus keeping the clip 14 in the latched position. This can be used to provide tamper evidence. It will be appreciated that the binding member can only be placed through a hole in the clip (such as hole 166) and a hole in the handle 82 (such as hole 152) however it is preferred to use the arrangement shown in FIG. 5.

Figure 7A:
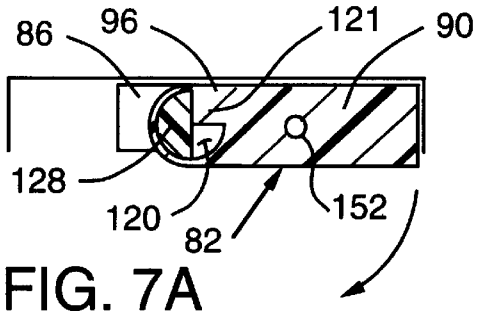
FIG. 7A is a cross-sectional view taken along line 7A—7A of FIG. 4.
Figure 7B:
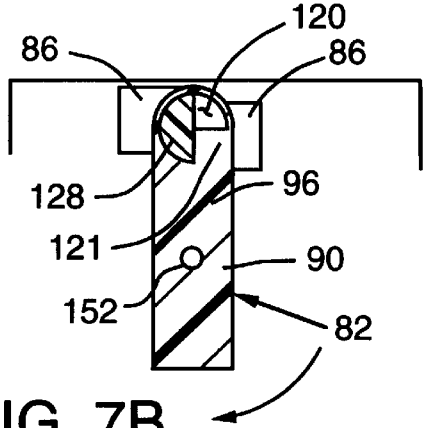
FIG. 7B is a cross-sectional view similar to FIG. 7A only showing the movable latch/release handle rotated 90° from the position shown in FIG. 7A.
Figure 7C:
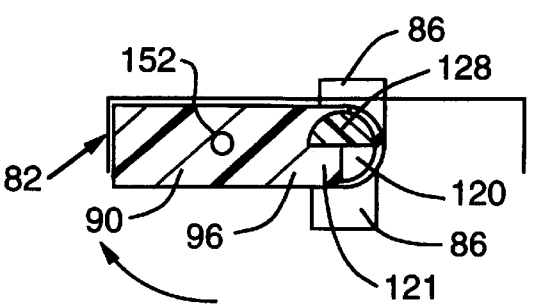
FIG. 7C is a cross-sectional view taken along line 7C—7C of FIG. 5.
Figure 7D:
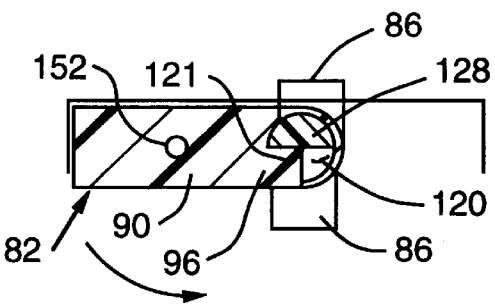
FIG. 7D is a view identical to FIG. 7C to illustrate the unlatching of the movable latch/release handle.

Referring to FIGS. 7A–7F, the operation of the mounting clip 14 will be explained. FIG. 7A is taken along line 7A—7A of FIG. 4. The movable latch/release handle 82 in this view is in the unlatched position. The half shaft section 128 occupies the left side of the shaft opening 120 while the pie-shaped portion 121 of the section 96 occupies the right top quadrant of the shaft opening 120. Upon 90° rotation of the movable latch/release handle 82 as shown in FIG. 7B, the pie-shaped portion 121 is rotated 90° and moves into the lower right quadrant of the shaft opening 120. It will be appreciated that this movement does not move the half shaft 128, and thus the locking toggle 86 dos not move and stays in its unlatched position as is shown in FIG. 7B. Upon further 90° rotation of the movable latch/release handle 82 as shown in FIG. 7C, the pie-shaped portion 121 engages against the half shaft 128 and rotates the half shaft 90°, with the pie-shaped portion 121 now occupying the lower left quadrant of the shaft opening 120. The 90° rotation of the half shaft 128 in turn causes 90° rotation of the locking toggle 86 into the latched position as shown in FIG. 7C (see FIG. 5).

Figure 7E:
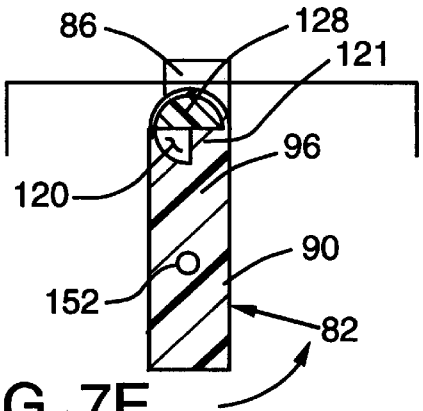
FIG. 7E is a view similar to FIG. 7E only showing the movable latch/release handle rotated 90° from the position shown in FIG. 7D.
Figure 7F:
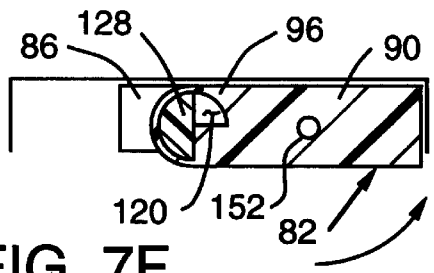
FIG. 7F is a view identical to FIG. 7A to illustrate the completion of the unlatching procedure.

Once it is desired to move the movable latch/release handle 82 into the unlatched position from the latched position (FIG. 7D), the handle 82 is then moved 90° to the right as shown in FIG. 7E. Again this 90° movement (as in FIG. 7B) does not cause any rotation of the locking toggle 86 because the pie-shaped portion 121 merely moves from the left lower quadrant to the open right lower quadrant without engaging against the half shaft 128. Further 90° rotation of the handle 82, however, will result in 90° rotation of the half shaft 128 and thus the toggle 86 into the unlatched position as shown in FIG. 7F.

Figure 8:
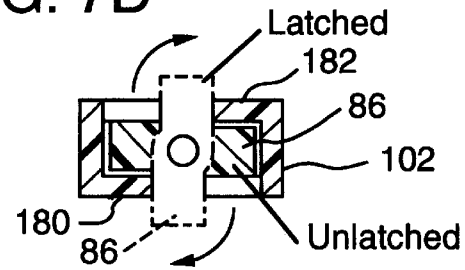
FIG. 8 is a cross-sectional view taken along line 8—8 of FIG. 3.

Another feature of the invention is shown by referring to FIG. 3 and FIG. 8. The cage-like assembly 102 includes stop means to limit the movement of the locking toggle 86 therein. One embodiment of the stop means is shown in FIG. 8, which includes flanges 180 and 182 which are integral with the sidewall of the cage-like assembly 102. As will be appreciated, the stop means limit the rotation of the locking toggle 86 to an arc of 90°. Specifically, the locking toggle 86 can rotate clockwise no more than 90° from unlatched to latched position (as shown in FIG. 8). Conversely, the locking toggle 86 can rotate counterclockwise no more than 90° from the latched to the unlatched position. This will prevent a person from rotating the locking toggle 86 clockwise when it is in the latched position and conversely rotating the locking toggle counterclockwise when it is in the unlatched position.

It will be appreciated that a storage container including a unique mounting clip has been disclosed. The mounting clip is easy to use and easy to manufacture and avoids the problems presented by prior art mounting clips.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A method of forming a storage container comprising:

providing a pallet having a section which defines a mounting clip receiving slot;

providing a bin with a sidewall structure having a first mounting clip secured near an edge thereof, said mounting clip having a first section including a rotatable latch/release handle and a second section including a rotatable locking toggle operatively associated with said rotatable latch/release handle, said locking toggle being in an unlatched position when said locking toggle lies generally in a first plane formed by said second section;

inserting said second section into said mounting clip receiving slot; and rotating said latch/release handle so that said locking toggle lies in a second plane that is generally perpendicular to said first plane in order to resist removal of said sidewall from said pallet while said latch/release handle is in said first plane.

2. A mounting clip for removably interconnecting a pallet having a mounting clip receiving slot, said mounting clip having a first section including a movable latch/release handle and a second section including a locking toggle operatively associated with said movable latch/release handle, said second section adapted to being inserted into said slot and said locking toggle being moved by means of said movable latch/release handle from a first position to a second position, said first position is when said locking toggle lies generally in a first plane formed by said second section so that said second section can be inserted into and removed from said slot and said second position is when said locking toggle lies in a second plane that is generally perpendicular to said first plane in order to resist removal of said sidewall from said pallet, said movable latch/release handle lies in said first plane when said locking toggle is in said second position.

3. A storage container comprising:

a pallet having a section which defines a mounting clip receiving slot;

a sidewall structure having a mounting clip secured near an edge thereof, said mounting clip having a first section including a movable latch/release handle and a second section including a locking toggle operatively associated with said movable latch/release handle, said second section being inserted into said slot and said locking toggle being moved by means of said movable latch/release handle from an unlatched position to a latched position wherein said sidewall structure is attached to said pallet; and said movable latch/release handle and said locking toggle are constructed and arranged so that a 180° rotation of said movable latch/release handle causes a 90° rotation of said locking toggle.

4. The container of claim 3, wherein said section defining said mounting clip receiving slot has a first edge surface and a second edge surface opposite said first edge surface, said locking toggle in said latched position resisting removal from said pallet due to said toggle engaging against said second edge surface.

5. A storage container comprising:

a pallet having a section which defines a mounting clip receiving slot;

a sidewall structure having a mounting clip secured near an edge thereof, said mounting clip having a first section including a movable latch/release handle and a second section including a locking toggle operatively associated with said movable latch/release handle, said second section being inserted into said slot and said locking toggle being moved by means of said movable latch/release handle from an unlatched position to a latched position wherein said sidewall structure is attached to said pallet;

said unlatched position is when said locking toggle lies generally in a first plane formed by said second section so that said second section can be inserted into and removed from said slot and said latched position is when said locking toggle lies in a second plane that is generally perpendicular to said first plane in order to resist removal of said sidewall from said pallet;

said section defining said mounting clip receiving slot has a first edge surface and a second edge surface opposite said first edge surface, said locking toggle in said latched position resisting removal from said pallet due to said toggle engaging against said second edge surface; and said movable latch/release handle lies in said first plane when said locking toggle is in said latched position.

6. The container of claim 5, wherein said movable latch/release handle lies in said first plane when said locking toggle is in said unlatched position.

7. The container of claim 5, wherein said movable latch/release handle includes at least one detent that engages against said first section when said movable latch/release handle is in said latched or unlatched position.

8. The container of claim 5, including means for securing said movable latch/release handle in said latched position.

9. A storage container comprising:

a pallet having a section which defines a mounting clip receiving slot;

a sidewall structure having a mounting clip secured near an edge thereof, said mounting clip having a first section including a movable latch/release handle and a second section including a locking toggle operatively associated with said movable latch/release handle, said second section being inserted into said slot and said locking toggle being moved by means of said movable latch/release handle from an unlatched position to a latched position wherein said sidewall structure is attached to said pallet; and said handle includes a hole and said first section includes a hole, said handle hole and said first section hole being aligned and adapted to receive a binding member in order to secure said handle to said first section while said locking toggle is in said latched position and to provide tamper evidence.

10. A storage container comprising:

a pallet having a section which defines a mounting clip receiving slot;

a sidewall structure having a mounting clip secured near an edge thereof, said mounting clip having a first section including a movable latch/release handle and a second section including a locking toggle operatively associated with said movable latch/release handle, said second section being inserted into said slot and said locking toggle being moved by means of said movable latch/release handle from an unlatched position to a latched position wherein said sidewall structure is attached to said pallet;

said handle defines a shaft opening having a cross-section extending through an arc of about 270°; and a shaft extending from said locking toggle into said shaft opening, the portion of said shaft disposed in said shaft opening having a semi-circular cross-section, whereby 180° rotation of said handle causes a 90° rotation of said shaft and said locking toggle.

11. The container of claim 10, wherein said handle includes a finger opening to facilitate rotation thereof.

12. A storage container comprising:

a pallet having a section which defines a mounting clip receiving slot;

a sidewall structure having a mounting clip secured near an edge thereof, said mounting clip having a first section including a movable latch/release handle and a second section including a locking toggle operatively associated with said movable latch/release handle, said second section being inserted into said slot and said locking toggle being moved by means of said movable latch/release handle from an unlatched position to a latched position wherein said sidewall structure is attached to said pallet;

said sidewall structure includes a first cutout portion extending from said edge thereof and a second cutout portion spaced from said first cutout portion;

said first section includes a main body portion and a sidewall attachment portion; and said main body and said locking toggle are disposed in said first cutout portion and said sidewall attachment portion engages into said second cutout portion in order to secure said mounting clip to said sidewall structure.

13. The container of claim 5, wherein said sidewall structure is made of corrugated plastic.

14. The container of claim 5, wherein a plurality of mounting clips secured to a bottom edge of said sidewall structure.

15. The container of claim 14, wherein at least one mounting clip secured to a top edge of said sidewall structure, whereby another pallet can be attached to said top edge of said sidewall.

16. The container of claim 5, wherein said sidewall structure is a collapsible corrugated plastic bin that is foldable for flat storage.

17. The container of claim 5, wherein said locking toggle is enclosed in a frame.

18. The container of claim 17, wherein said frame includes stop means for limiting rotation of said locking toggle.

19. A mounting clip for removably interconnecting a pallet having a mounting clip receiving slot, said mounting clip having a first section including a movable latch/release handle and a second section including a locking toggle operatively associated with said movable latch/release handle, said second section adapted to being inserted into said slot and said locking toggle being moved by means of said movable latch/release handle from a first position to a second position; and said movable latch/release handle and said locking toggle are constructed and arranged so that a 180° rotation of said movable latch/release handle causes a 90° rotation of said locking toggle.

20. The mounting clip of claim 2, wherein said movable latch/release handle includes at least one detent that engages against said first section when said movable latch/release handle is in said latched or unlatched position.

21. A mounting clip for removably interconnecting a pallet having a mounting clip receiving slot, said mounting clip having a first section including a movable latch/release handle and a second section including a locking toggle operatively associated with said movable latch/release handle, said second section adapted to being inserted into said slot and said locking toggle being moved by means of said movable latch/release handle from a first position to a second position; and said handle includes a sealing hole and said first section includes a sealing hole, said handle sealing hole and said first section sealing hole being aligned and adapted to receive a sealant in order to secure said handle to said first section while said locking toggle is in said latched position.

22. A mounting clip for removably interconnecting a pallet having a mounting clip receiving slot, said mounting clip having a first section including a movable latch/release handle and a second section including a locking toggle operatively associated with said movable latch/release handle, said second section adapted to being inserted into said slot and said locking toggle being moved by means of said movable latch/release handle from a first position to a second position; and said handle defines a shaft opening having a cross-section extending through an arc of about 270°; and a shaft extending from said locking toggle into said shaft opening, the portion of said shaft disposed in said shaft opening having a semi-circular cross-section, whereby 180° rotation of said handle causes a 90° rotation of said shaft and said locking toggle.

23. The mounting clip of claim 22, wherein said handle includes a finger opening to facilitate rotation thereof.

24. The mounting clip of claim 2, wherein said locking toggle is enclosed in a frame.

25. The mounting clip of claim 24, wherein said frame includes stop means for limiting rotation of said locking toggle.

26. A method of forming a storage container comprising:

providing a pallet having a section which defines a mounting clip receiving slot;

providing a bin with a sidewall structure having a first mounting clip secured near an edge thereof, said mounting clip having a first section including a rotatable latch/release handle and a second section including a rotatable locking toggle operatively associated with said rotatable latch/release handle;

inserting said second section into said mounting clip receiving slot; and rotating said latch/release handle about 180° to cause said locking toggle to move from an unlatched position to a latched position wherein said locking toggle rotates about 90° when said movable latch/release handle is rotated about 180°.

* * * * *